US011268164B2

(12) United States Patent
Yoshioka et al.

(10) Patent No.: US 11,268,164 B2
(45) Date of Patent: Mar. 8, 2022

(54) STEEL SHEET AND METHOD FOR PRODUCING THE SAME

(71) Applicant: JFE STEEL CORPORATION, Tokyo (JP)

(72) Inventors: Shimpei Yoshioka, Tokyo (JP); Yoshihiko Ono, Tokyo (JP); Kenta Hidaka, Tokyo (JP); Ryosuke Yamaguchi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 196 days.

(21) Appl. No.: 16/329,504

(22) PCT Filed: Sep. 28, 2017

(86) PCT No.: PCT/JP2017/035200
§ 371 (c)(1),
(2) Date: Feb. 28, 2019

(87) PCT Pub. No.: WO2018/062381
PCT Pub. Date: Apr. 5, 2018

(65) Prior Publication Data

US 2019/0203317 A1 Jul. 4, 2019

(30) Foreign Application Priority Data

Sep. 28, 2016 (JP) ..... JP2016-189895

(51) Int. Cl.
*C21D 9/46* (2006.01)
*C21D 8/02* (2006.01)
(Continued)

(52) U.S. Cl.
CPC ..... *C21D 9/46* (2013.01); *C21D 1/18* (2013.01); *C21D 8/0226* (2013.01);
(Continued)

(58) Field of Classification Search
CPC ..... C21D 2211/002; C21D 2211/008; C21D 1/26; C21D 1/28; C21D 1/30; C21D 1/32;
(Continued)

(56) References Cited

U.S. PATENT DOCUMENTS

2013/0040165 A1 2/2013 Shiraki et al.
2013/0142688 A1 6/2013 Yamamoto et al.
(Continued)

FOREIGN PATENT DOCUMENTS

CN 104220622 A 12/2014
EP 2 837 708 A1 2/2015
(Continued)

OTHER PUBLICATIONS

Jun. 5, 2019 Extended Search Report issued in European Patent Application No. 17856330.0.
(Continued)

*Primary Examiner* — Vanessa T. Luk
(74) *Attorney, Agent, or Firm* — Oliff PLC

(57) ABSTRACT

A steel sheet having a specified chemical composition and a method for producing the steel sheet. The steel sheet has a microstructure including martensite and bainite. The total area fraction of the martensite and the bainite to the entirety of the microstructure is 95% or more and 100% or less. The balance of the microstructure is at least one of ferrite and retained austenite. The microstructure includes specific inclusion clusters, the content of the inclusion clusters in the microstructure being 5 clusters/mm$^2$ or less. The microstructure includes prior-austenite grains having an average size of more than 5 μm. The steel sheet has a tensile strength of 1320 MPa or more.

8 Claims, 1 Drawing Sheet

(51) Int. Cl.

| | |
|---|---|
| ***C22C 38/12*** | (2006.01) |
| ***C23C 2/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C23C 2/02*** | (2006.01) |
| ***C23C 2/40*** | (2006.01) |
| ***C21D 1/18*** | (2006.01) |
| ***C22C 38/18*** | (2006.01) |
| ***C23C 2/28*** | (2006.01) |
| ***C22C 38/60*** | (2006.01) |

(52) U.S. Cl.
CPC ..... *C21D 8/0236* (2013.01); *C21D 8/0247* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/26* (2013.01); *C22C 38/28* (2013.01); *C22C 38/60* (2013.01); *C23C 2/02* (2013.01); *C23C 2/06* (2013.01); *C23C 2/28* (2013.01); *C23C 2/40* (2013.01); *C21D 8/0205* (2013.01); *C21D 2211/002* (2013.01); *C21D 2211/008* (2013.01)

(58) Field of Classification Search
CPC ..... C21D 6/00; C21D 6/001; C21D 6/002; C21D 6/004; C21D 6/005; C21D 6/007; C21D 6/008; C21D 6/02; C21D 6/04; C21D 8/005; C21D 8/0273; C21D 8/0473; C21D 8/1272; C21D 9/46; C21D 9/48
See application file for complete search history.

(56) References Cited

U.S. PATENT DOCUMENTS

| | | | | |
|---|---|---|---|---|
| 2015/0027593 | A1* | 1/2015 | Hata | C22C 38/04 148/504 |
| 2016/0304981 | A1* | 10/2016 | Song | C21D 8/0273 |
| 2017/0073792 | A1 | 3/2017 | Hikida et al. | |
| 2018/0100212 | A1* | 4/2018 | Ono | C22C 38/001 |

FOREIGN PATENT DOCUMENTS

| | | | | |
|---|---|---|---|---|
| JP | 3514276 | B2 | | 3/2004 |
| JP | 4427010 | B2 | | 3/2010 |
| JP | 2010-215958 | A | | 9/2010 |
| JP | 2010215958 | A | * | 9/2010 |
| JP | 2010-242164 | A | | 10/2010 |
| JP | 2012-197506 | A | | 10/2012 |
| JP | 2012-237048 | A | | 12/2012 |
| JP | 5423072 | B2 | | 2/2014 |
| JP | 5428705 | B2 | | 2/2014 |
| JP | 54-31019 | B2 | | 3/2014 |
| JP | 5463715 | B2 | | 4/2014 |
| JP | 2015-151576 | A | | 8/2015 |
| JP | 5824401 | B2 | | 11/2015 |
| WO | 2015/088514 | A1 | | 6/2015 |
| WO | 2015/174530 | A1 | | 11/2015 |
| WO | WO-2016152163 | A1 | * | 9/2016 ..... C21D 9/46 |

OTHER PUBLICATIONS

Lee, Dong-Eun, "Evaluation of Optimal Residence Time in a Hot Rolled Reheating Furnace", International Scholarly and Scientific Research & Innovation, vol. 5, No. 11 (2011).
"Residual Elements in Steel", https://www.totalmateria.com/page.aspx?ID=CheckArticle&LN=EN&site=kts&NM=205 (2007).
Kodym, Manfred et al., "Spurenelemente Im Stahl—Möglichkeiten Zur Beeinflussung Im Schmelzbetrieb", Spurenelemente in Staehlen, Verlag Stahleisen, pp. 19-22 (1985).
Dec. 19, 2017 International Search Report issued in International Application No. PCT/JP2017/035200.
May 15, 2020 Office Action issued in Chinese Patent Application No. 201780053051.2.
Aug. 19, 2020 Office Action issued in Korean Patent Application No. 10-2019-7005494.
Nov. 26, 2020 Office Action issued in Chinese Patent Application No. 201780053051.2.
Apr. 1, 2021 Office Action issued in Chinese Patent Application No. 201780053051.2.
Aug. 11, 2021 Office Action issued in Chinese Patent Application No. 201780053051.2.

* cited by examiner

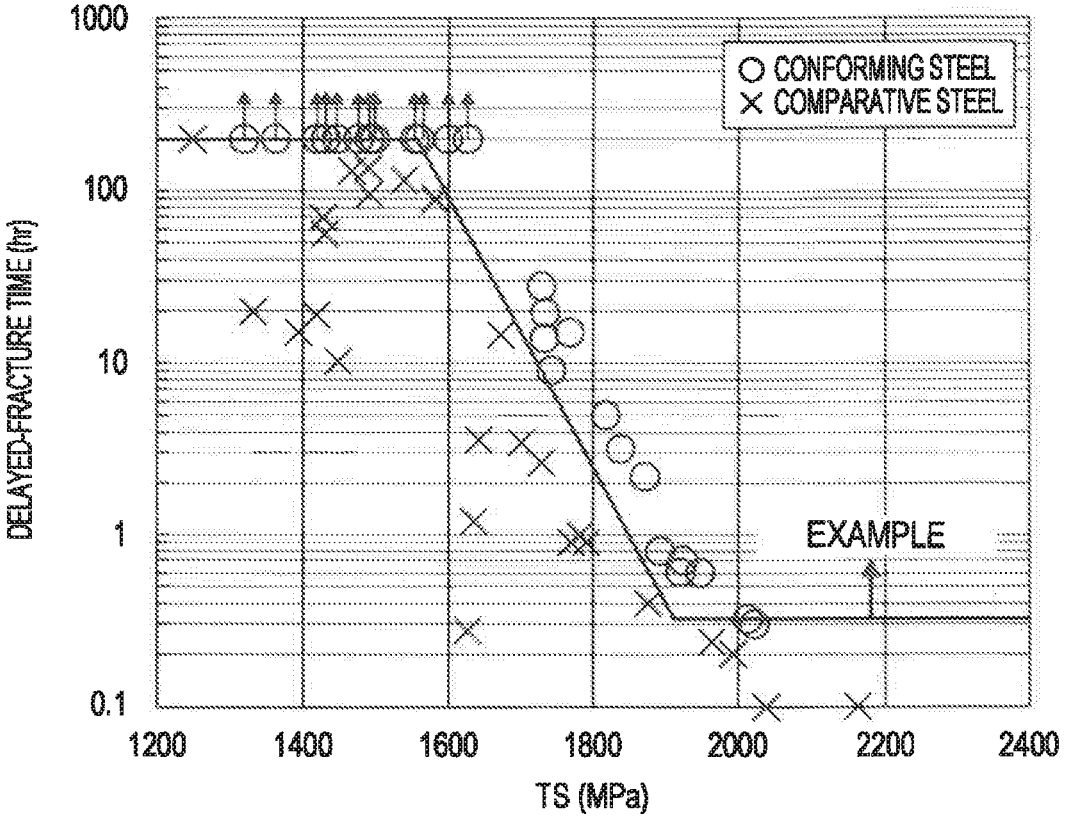
1000
100
10
1
0.1
DELAYED-FRACTURE TIME (hr)
1200
1400
1600
1800
2000
2200
2400
TS (MPa)
CONFORMING STEEL
COMPARATIVE STEEL
EXAMPLE

STEEL SHEET AND METHOD FOR PRODUCING THE SAME

TECHNICAL FIELD

This application relates to a steel sheet and a method for producing the steel sheet. The steel sheet can be suitably used as a high-strength steel sheet for cold-press forming which is formed into components of automobiles, electrical household appliances, and the like by cold pressing.

BACKGROUND

With an increasing demand for reductions in the weights of automotive bodies, the application of high-strength steel sheets having a tensile strength (TS) of 1320 to 1470 MPa to vehicle frame components, such as center pillar R/F (reinforcement), bumpers, impact beams, and the like, becoming popular. In order to further reduce the weights of automotive bodies, studies of the application of steel sheets having a TS of about 1.8 GPa or more are being started. There have been extensive studies of production. of high-strength steel sheets by performing pressing at high temperatures, that is, hot pressing. On the other hand, the application of high-strength steel in which steel sheets are cold-pressed into shape is being reconsidered from the viewpoints of cost and productivity.

However, in the case where a high-strength steel sheet having a TS of about 1320 MPa or more is formed into a component by cold pressing, delayed fracture of the steel sheet becomes significant as a result of an increase in the residual stress inside the component and degradation of delayed fracture resistance of the steel sheet. Delayed fracture is a phenomenon where, when a component is placed under a hydrogen-penetrating environment while a high stress is applied to the component, hydrogen that penetrates the steel sheet reduces the interatomic bonding forces and causes local deformation of the steel sheet, which leads to formation of microcracks, and the component is fractured as a result of the propagation of the microcracks. The delayed fracture of actual components occurs primarily at end surfaces of the steel sheet cut by shearing. This is presumably because the sheared end surfaces include a zone in which the fracture limit strain has been reached and a part of the sheared end surface which is in the vicinity of such a zone is considerably work-hardened (the proportionality limit has been increased), which results in a significant increase in stress that remains after the subsequent press forming. The critical delayed fracture stress of a steel sheet having untreated sheared end surfaces is ⅓ to 1/20 the critical delayed fracture stress of a steel sheet having sheared end surfaces from which the above zone has been removed by reaming. That is, it is considered that delayed fracture resistance at the sheared end surfaces is one of the principal factors that determine the resistance of an actual component to delayed fracture.

There have been disclosed various techniques for improving the delayed fracture resistance of a steel sheet. For example, on the basis of the finding that, among steel sheets having the same strength, the higher the content of additive elements, the lower the delayed fracture resistance, Patent Literature 1 discloses an ultrahigh-strength steel sheet having excellent delayed fracture resistance which has a composition containing C: 0.008% to 0.18%, Si: 1% or less, Mn: 1.2% to 1.8%, S: 0.01% or less, N: 0.005% or less, and 0: 0.005% or less, the composition satisfying the following relationship between Ceq and TS: TS≥2270×Ceq+260 and Ceq≤0.5, where Ceq=C+Si/24+Mn/6, and a microstructure including martensite, the volume fraction of martensite in the microstructure being 80% or more.

Patent Literatures 2, 3, and 4 disclose techniques in which resistance to hydrogen-induced cracking is reduced by reducing the S content in steel to a predetermined level and adding Ca to the steel.

Patent Literature 5 discloses a technique in which delayed fracture resistance is improved by adding one or more of V 0.05% to 2.82%, Mo: 0.1% or more and less than 3.0%, Ti: 0.03% to 1.24%, and Nb: 0.05% to 0.95% to a steel having a composition containing C: 0.1% to 0.5%, Si: 0.10% to 2%, Mn: 0.44% to 3%, N≤0.008%, Al: 0.005% to 0.1%, and dispersing fine alloy carbide particles, which serve as hydrogen-trapping sites, in the steel.

CITATION LIST

Patent Literature

PTL 1: Japanese Patent No. 3514276
PTL 2: Japanese Patent No. 5428705
PLT 3: Japanese Unexamined Patent Applicat Publication No. 54-31019
PTL 4: Japanese Patent No. 5824401
PTL 5: Japanese Patent No. 4427010

SUMMARY

Technical Problem

However, in all of the above-described techniques, attempt is made to improve the delayed fracture resistance of a steel material itself; delayed fracture resistance at shared end surfaces, in which the fracture limit strain has been reached before the steel sheet is formed into shape by pressing, is not considered sufficiently. Therefore, it cannot be said that the advantageous effects of the above-described techniques are sufficiently large.

The disclosed embodiments were made in order to address the foregoing issues. An object of the disclosed embodiments is to provide a steel sheet that has a TS of 1320 MPa or more and enables a component produced by blanking the steel sheet by shearing or slitting or drilling holes in the steel sheet by punching and subsequently cold-pressing the steel sheet or by cold-pressing the steel sheet and cutting the resulting component by shearing or drilling holes in the component by punching to have excellent delayed fracture resistance. Another object of the disclosed embodiments is to provide a method for producing the steel sheet.

Solution to Problem

The inventors conducted extensive studies in order to address the above issues and, consequently, found the following facts.

i) Delayed fracture resistance of an ultrahigh-strength steel sheet having a TS of 1320 MPa or more at punched end surfaces cannot be enhanced to a sufficient level only by reducing the amount of inclusion particles having a diameter of 100 μm or more, which have been considered to adversely affect bendability. It was found that the above property became significantly degraded by inclusion clusters each of which is constituted by one or more inclusion particles and has a major axis of 20 to 80 μm, even when the inclusion particles are small. The inclusion particles constituting the inclusion clusters are composed primarily of Mn-, Ti-, Zr-, Ca-, and REM-sulfides, Al-, Ca-, Mg-, Si-, and Na-oxides, Ti-, Zr-, Nb-, and Al-nitrides, Ti-, Nb-, Zr-, and Mo-carbides, and composite precipitates of these substances. Fe carbides are not included in the inclusion articles.

ii) It was found that, for appropriately controlling the inclusion clusters having a length of 20 to 80 μm, it is necessary to adjust the contents of N, S, O, Mn, Nb, and Ti in steel, a temperature at which the slab is heated, and an amount of time during which heating and holding are performed to be adequate.

iii) It has been considered that Nb and Ti precipitates reduce the size of prior-γ grains and thereby improve delayed fracture resistance. However, it was found that delayed fracture resistance can be remarkably improved by increasing an annealing temperature in a continuous annealing step and thereby increasing the size of prior-γ grains. Although the mechanisms responsible for this are not clear, the inventors had the following observation. Specifically, addition of Nb causes a change in the texture, which may affect the residual stress at the end surfaces formed by shearing and consequently enhance delayed fracture resistance. It is considered that, while prior-γ grains are grown in the annealing step, the degree of orientation of the texture is increased and, consequently, delayed fracture resistance is remarkably improved.

The disclosed embodiments were made on the basis of the above findings, and are further described below.

[1] A steel sheet including: a composition containing, by mass, C: 0.13% or more and 0.40% or less, Si: 1.5% or less, Mn: 1.7% or less, P: 0.030% or less, Si less than 0.0010%, sol. Al: 0.20% or less, N: 0.0055% or less, O: 0.0025% or less, Nb: 0.002% or more and 0.035% or less and Ti: 0.002% or more and 0.040% or less such that Formulae (1) and (2) are satisfied, and the balance being Fe and inevitable impurities; and a microstructure including martensite and bainite, the total area fraction of the martensite and the bainite to the entirety of the microstructure being 95% or more and 100% or less, and the balance being one or two of ferrite and retained austenite, the microstructure including prior-austenite grains having an average grain size of more than 5 μm, the microstructure including inclusion clusters that satisfy the conditions below, the inclusion clusters having a major axis of 20 to 80 μm, the content of the inclusion clusters in the microstructure being 5 clusters/mm$^2$ or less, the steel sheet having a tensile strength of 1320 MPa or more.

$$[\%\ Ti]+[\%\ Nb]>0.007 \quad (1)$$

$$[\%\ Ti]\times[\%\ Nb]^2 \leq 7.5\times10^{-6} \quad (2)$$

where [% Nb] and [% Ti] represent the contents (%) of Nb and Ti, respectively.

(Conditions)

Each of the inclusion clusters is constituted by one or more inclusion particles, the inclusion particles have a major axis of 0.3 μm or more, and, in the case where the inclusion clusters are constituted by two or more inclusion particles, the shortest distance between the inclusion particles is 10 μm or less.

[2] The steel sheet described in [1], wherein the composition further contains, by mass, B: 0.0002% or more and less than 0.0035%.

[3] The steel sheet described in [1] or [2], wherein the composition further contains, by mass, one or two elements selected from Cu: 0.005% or more and 1% or less and Ni: 0.01% or more and 1% or less.

[4] The steel sheet described in any one of [1] to [3], wherein the composition further contains, by mass, one or two or more elements selected from Cr: 0.01% or more and 1.0% or less, Mo: 0.01% or more and less than 0.3%, V: 0.003% or more and 0.45% or less, Zr: 0.005% or more and 0.2 or less, and W: 0.005% or more and 0.2% or less.

[5] The steel sheet described in any one of [1] to [4], wherein the composition further contains, by mass, one or two or more elements selected from Ca: 0.0002% or more and 0.0030% or ess, Ce: 0.0002% or more and 0.0030% or less, La: 0.0002% or more and 0.0030% or less, and Mg: 0.0002% or more and 0.0030% or less.

[6] The steel sheet described in any one of [1] to [5], wherein the composition further contains, by mass, one or two elements selected from Sb: 0.002% or more and 0.1% or less, and Sn: 0.002% or more and 0.1% or less.

[7] The steel sheet described in any one of [1] to [6], wherein the steel sheet has a coating layer on the surface thereof.

[8] A method for producing a steel sheet, the method including holding a steel slab having the composition described in any one of [1] to [6] for 100 minutes or more with a slab-surface temperature of 1220° C. or more and subsequently hot-rolling the steel slab into a hot-rolled steel sheet;

cold-rolling the hot-rolled steel sheet into a cold-rolled steel sheet at a cold-rolling ratio of 40% or more; and performing continuous annealing of the cold-rolled steel sheet, the continuous annealing including treating the cold-rolled steel sheet for 240 seconds or more with an annealing temperature higher than 850° C., subsequently reducing the temperature from 680° C. or more to 260° C. or less at an average cooling rate of 70° C./s or more, then performing reheating as needed, and subsequently performing holding at 150° C. to 260° C. for 20 to 1500 seconds.

[9] The method for producing a steel sheet described in [8], wherein coating of the steel sheet is performed subsequent to the continuous annealing.

Advantageous Effects

According to the disclosed embodiments, a high-strength steel sheet having excellent delayed fracture resistance at sheared end surfaces may be produced. The improvement in delayed fracture resistance at sheared end surfaces enables a high-strength steel sheet to be used in the application where the steel sheet is formed into shape by cold pressing followed or preceded by shearing or punching and thereby contributes to increases in the strengths of components and reductions in the weights of the components.

BRIEF DESCRIPTION OF THE DRAWINGS

FIG. 1 is a diagram illustrating the relationship between TS and delayed-fracture time.

DETAILED DESCRIPTION

Disclosed embodiments are described below. The disclosure is not intended to be limited by the following specific embodiments.

The steel sheet according to the disclosed embodiments has a composition containing, by mass, C: 0.13% or more and 0.40% or less, Si: 1.5% or less,Mn: 1.7% or less, P: 0.030% or less, S: less than 0.0010%, sol. Al: 0.20% or less, N: 0.0055% or less, O: 0.0025% or less, and Nb: 0.002% or more and 0.035% or less and Ti.0.002% or more 0.040% or less such that Formulae (1) and (2) are satisfied, and the balance being Fe and inevitable impurities.

The composition may further contain, by mass, B: 0.0002% or more and less than 0.0035%.

The composition may further contain, by mass, one or two elements selected from Cu: 0.005% or more and 1% or less and Ni: 0.01% or more and 1% or less.

The composition may further contain, by mass, one or two or more elements selected from Cr: 0.01% or more and 1.0% or less, Mo: 0.01% or more and less than 0.3%, V: 0.003% or more and 0.45 or less, Zr: 0.005% or more and 0.2% or less, and W: 0.005% or more and 0.2% or less.

The composition may further contain, by mass, one or two or more elements selected from Ca: 0.0002% or more and 0.0030% or less, Ce: 0.0002% or more and 0.0030% or less, La: 0.0002% or more and 0.0030% or less, and Mg: 0.0002% or more and 0.0030% or less.

The composition may further contain, by mass, one or two elements selected from Sb: 0.002% or more and 0.1% or less and Sn: 0.002% or more and 0.1% or less.

The content of each of the above elements is described below. When referring to the content of a constituent, the symbol "%" refers to "% by mass".

C: 0.13% or More and 0.40% or Less

C is added to steel in order to enhance hardenability and obtain a fraction of martensite and bainite in the microstructure to be 95% or more and to increase strength of martensite and bainite in order to achieve a TS of 1320 MPa or more. C is added to steel in order to form fine carbide particles inside martensite and bainite, which serve as hydrogen-trapping sites. If the C content is less than 0.13%, it becomes impossible to achieve the predetermined strength while maintaining excellent delayed fracture resistance. For achieving a TS of 1470 MPa or more while maintaining excellent delayed fracture resistance, the C content is desirably limited to be 0.18% or more. The C content is more preferably 0.20% or more. On the other hand, if the C content exceeds 0.40%, the strength of the steel sheet may be excessively increased, which makes it difficult to obtain sufficient delayed fracture resistance. The C content is preferably 0.35% or less and is more preferably 0.30% or less. Accordingly, the C content is limited to be 0.13% to 0.40%.

Si: 1.5% or Less

Si is added to steel as an element that strengthens steel by solid-solution strengthening. Si also suppresses a formation of film-like carbide particles when the steel sheet is tempered at 200° C. or more, and thereby improves the delayed fracture resistance. Si also reduces the segregation of Mn at the center of the steel sheet in the thickness direction and thereby suppresses a formation of MnS. Si also suppresses decarburization and a reduction in the B content due to oxidation of the surface layer in CAL annealing. The lower limit for the Si content is not specified; for achieving the above advantageous effects, it is desirable to include 0.02% or more of Si. The Si content is preferably 0.20% or more, is more preferably 0.40% or more, and is further preferably 0.60% or more. If the Si content is excessively high, the segregation of Si may be increased and, consequently, delayed fracture resistance may become deteriorated. Furthermore, the rolling load for hot rolling and cold rolling may be significantly increased. In addition, the toughness of the steel sheet may become degraded. Accordingly, the Si content is limited to be 1.5% or less (including 0% ). The Si content is preferably 1.4% or less, is more preferably 1.2% a less, and is further preferably 0.9% or less.

Mn: 1.7% or Less

Mn is added to steel in order to enhance the hardenability of steel and maintain predetermined total area fractions of martensite and bainite. Mn also combines with S included in steel to for: MnS, thereby fixes S, and consequently reduces hot brittleness. Mn is an element that especially facilitates a formation and coarsening of MnS particles at the center of the steel sheet in the thickness direction Mn forms composite precipitates with inclusion particles composed of $Al_2O_3$, (Nb, Ti) (C,N), TiN, TiS, and the like and thereby contributes to the formation of the microstructure that is to be formed in the disclosed embodiments. If the Mn content exceeds 1.7%, the number and size of the inclusion clusters are increased and, consequently, delayed fracture resistance at sheared end surfaces may become deteriorated significantly. Accordingly, the Mn content is limited to be 1.7% or less. In order to further reduce the amount of the coarse MnS particles and improve delayed fracture resistance, the Mn content is preferably adjusted to be 1.4% or less, The Mn content more preferably 1.3or less. In order to maintain the predetermined total area fraction of martensite and bainite in an industrially consistent manner, the Mn content is preferably adjusted to be 0.2% or more. The Mn content is more preferably 0.4% or more and is further preferably 0.6% or more.

P: 0.030% or Less

Although P is an element that strengthens steel, if the P content is excessively high, delayed fracture resistance and spot weldability may become degraded significantly. Accordingly, the P content is limited to be 0.030% or less. For the above reason, the P content is preferably adjusted to be 0.004% or less. The lower limitation of the P content is not specified. The lowest limitation of the P content which is industrially feasible is currently about 0.002%.

S: Less Than 0.0010%

It is necessary to accurately control the S content because S significantly deteriorates delayed fracture resistance at sheared end surfaces by forming MnS, TiS, Ti(C,S), and the like. It is considered insufficient to reduce only the amount of coarse MnS particles having a diameter of more than 80 μm, which have been considered to adversely affect bendability and the like; it is necessary to adjust also the amount of inclusion particles formed as a result of MnS precipitating with inclusion particles composed of $Al_2O_3$, (Nb, Ti) (C,N), TiN, TiS, and the like as composite precipitates for achieving the microstructure that is to be formed in the disclosed embodiments. The above adjustment remarkably improves delayed fracture resistance. For reducing the negative impacts of the inclusion clusters, it is necessary to limit the S content to less than 0.0010% at least. In order to improve delayed fracture resistance, the S content is preferably adjusted to be 0.0004% or less. The lower limitation of the S content is not specified. The lowest limitation of the S content which is industrially feasible is currently about 0.0002%, and the S content is substantially higher than the lower limit.

Sol. Al: 0.20% or Less

Al is added to steel in order to perform deoxidation to a sufficient degree and reduce the amount of inclusions present in the steel. Although the lower limit for the sol. Al content is not specified, for performing deoxidation consistently, it is desirable to adjust the sol. Al content to be 0.01% or more. The sol. Al content is more preferably 0.02% or more. However, if the sol. Al content exceeds 0.20%, cementite produced during coiling becomes difficult to dissolve during annealing and, consequently, delayed fracture resistance may become deteriorated. Accordingly, the Al content is limited to be 0.20% or less. The Al content is preferably 0.10% or less and is more preferably 0.05% or less.

N. 0.0055% or Less

N is an element that forms nitride and carbonitride inclusions, such as TIN, (Nb, Ti) (C,N), and AlN, in steel and may degrade delayed fracture resistance. The above inclusions inhibit the achievement of the microstructure required in the disclosed embodiments and cause negative impacts on delayed fracture resistance at sheared end surfaces. For reducing the negative impacts, it is necessary to limit the N content to be 0.0055% or less at least. The N content is preferably 0.0050% or less, is more preferably 0.0045% or less, and is further preferably 0.0040% or less. The lower limit for the N content is not specified. The lowest limitation for the N content which is industrially feasible is currently about 0.0006%, O: 0.00256 or Less O forms particles of oxide inclusions, such as $Al_2O_3$, $SiO_2$, CaO, and MgO, having a diameter of 1 to 20 μm in steel. O also forms composite inclusions having a low melting point with Al, Si, Mn, Na, Ca, Mg, or the like. By forming the above inclusions, O may deteriorate delayed fracture resistance. Each of the inclusions may cause negative impacts by degrading the smoothness and flatness of the sheared end surfaces and locally increasing the residual stress. For reducing the negative impacts, it is necessary to limit the O content to be 0.0025% or less at least. The O content is preferably 0.0023% or less and is more preferably 0.0020% or less. The lower limit for the O content is not specified. The lowest limitation of the O content which is industrially feasible is currently about 0.0005%.

Nb: 0.002% or More and 0.035% or Less

Nb facilitates the formation of martensite and bainite having a fine internal structure, thereby increasing the strength of the steel sheet and remarkably improving the delayed fracture resistance as described above. For the above reasons, the Nb content is limited to be 0.002% or more. The Nb content is preferably 0.005% or more and is more preferably 0.010% or more. However, it was found that, in the disclosed embodiments where the C content may be set to 0.21% or more in order to produce an ultrahigh-strength steel sheet, increasing the Nb content may deteriorate delayed fracture resistance on the contrary. As a result of the study of this mechanism, it was found that, when the proportion of the Nb content to the Ti content exceeds a certain value, inclusion clusters having a size of 20 to 80 μm which are distributed in a dotted-line manner in the rolling direction and constituted by particles of Nb inclusions, such as NbN, Nb(C,N), and (Nb, Ti) (C,N), are formed in a large amount. The above inclusion clusters may degrade delayed fracture resistance. In order to reduce the negative impacts, the Nb content is limited to be 0.035% or less. The Nb content is preferably 0.030% or less, is more preferably 0.025% or less, and is further preferably 0.023% or less.

Ti: 0.002% or More and 0.040% or Less

Ti facilitates a formation of martensite and bainite having a fine internal structure and thereby increases strength of the steel sheet. Ti also forms fine Ti carbide and carbonitride particles that serve as hydrogen-trapping sites and thereby remarkably improves delayed fracture resistance. Ti also improves castability. For the above reasons, the Ti content is limited to be 0.002% or more. The Ti content is preferably 0.005% or more and is more preferably 0.010% or more. However, it was found that, in the disclosed embodiments where the C content may be set to 0.21% or more in order to produce an ultrahigh-strength steel sheet, when the proportion of the Ti content to the Nb content exceeds a certain value, inclusion clusters having a size of 20 to 80 μm which are distributed in a dotted-line manner in the rolling direction and constituted by particles of Ti inclusions, such as TIN, Ti(C,N), Ti(C,S), TiS, and (Nb, Ti) (C,N), are formed in a large amount. The above inclusion clusters may deteriorate delayed fracture resistance. In order to reduce the negative impacts, the Ti content is limited to be 0.040% or less. The Ti content is preferably 0.035% or less, is more preferably 0.030% or less, and is further preferably 0.0250 or less.

$$[\%\ Ti]+[\%\ Nb]>0.007$$

$$[\%\ Ti]\times[\%\ Nb]^2\leq 7.5\times 10^{-6}$$

It is necessary to control the contents of Ti and Nb to be within predetermined ranges for controlling the texture and maintaining the hydrogen-trapping effect due to fine precipitates by the addition of Ti and Nb while educing the negative impacts of the coarse Ti and Nb precipitates on the degradation in delayed fracture property. For controlling the texture and maintaining the hydrogen-trapping effect due to fine precipitates by the addition of Ti and Nb, it is necessary to adjust the contents of Nb and Ti such that [% Ti]+[% Nb]>0.007. [% Ti]+[% Nb] preferably 0.010% or more, is more preferably 0.015% or more, and is further preferably 0.020% or more. As for the upper limitation of [% Ti]+[% Nb], [% Ti]+[% Nb] is preferably 0.070% or less, is more preferably 0.060% or less, and is further preferably 0.050% or less.

The solid-solubility limit of Nb in a steel containing 0.21% or more C low. In the case where Nb and Ti are added to steel in combination, (Nb, Ti) (C,N) and (Nb, Ti) (C,S), which are highly stable at temperatures of 1200° C. or more, are likely to be formed and the solid-solubility limits of Nb and Ti are significantly reduced. For reducing the amount of precipitates that remain undissolved due to the reduction in solid-solubility limit, it is necessary to control the contents of Nb and Ti such that $[\%\ Ti]\times[\%\ Nb]^2\leq 6.0\times 10^{-6}$ $7.5\times 10^{-6}$. It is preferable that $[\%\ Ti]\times[\%\ Nb]^2\leq 6.0\times 10^{-6}$ be satisfied. It is more preferable that $[\%\ Ti]\times[\%\ Nb]^2\leq 5.5\times 10^{-6}$ be satisfied. It is further preferable that $[\%\ Ti]\times[\%\ Nb]^2\leq 5.0\times 10^{=6}$ be satisfied. It is preferable that $[\%\ Ti]\times[\%\ Nb]^2\geq 1.0\times 10^{-8}$ be satisfied. It is more preferable that $[\%\ Ti]\times[\%\ Nb]^2\geq 1.0\times 10^{-7}$ be satisfied.

In addition to the above fundamental constituents, the composition of the steel sheet according to the disclosed embodiments may further contain the optional elements described below.

B: 0.0002% or More and Less Than 0.0035%

B is an element that enhances the hardenability of steel and enables predetermined area fractions of martensite and bainite to be formed even when the Mn content is low. In order to achieve the above advantageous effects of B, the B content is preferably adjusted to be 0.0002% or more and is further preferably adjusted to be 0.0005% or more. The B content is more preferably 0.0010% or more. For fixing N, it is desirable to use B in combination with 0.002% or more of Ti. If the B content is 0.0035% or more, the advantageous effects may stop increasing. Furthermore, the rate at which cementite dissolves during annealing is reduced and, consequently, some of the cementite particles may remain undissolved. This deteriorates delayed fracture resistance at sheared end surfaces. The B content is preferably 0.0030% or less and is further preferably 0.0025% or less. Thus, the B content is limited to be 0.0002% or more and less than 0.0035%.

Cu: 0.005% or More and 1% or Less

Cu enhances the corrosion resistance under the service conditions of automobiles. Furthermore, when Cu is added to steel, the corrosion product covers the surface of the steel sheet to reduce the penetration of hydrogen into the steel sheet. Cu is an element that enters steel in the case where scrap is used as a raw material. Accepting the entry of Cu enables post-consumer materials to be reused as a raw material and reduces the production costs. For the above reasons, it is preferable to limit the Cu content to be 0.005% or more. In order to improve delayed fracture resistance, it is desirable to limit the Cu content to be 0.05% or more. The Cu content is more preferably 0.10% or more. However, if the Cu content is excessively high, Cu may cause surface defect. Thus, it is desirable to limit the Cu content to be 1% or less. The Cu content is more preferably 0.50% or less and is further preferably 0.30% or less.

Ni: 0.01% or More and 1% or Less

Ni is an element that enhances the corrosion resistance. Ni also reduces the occurrence of surface defect, which is likely to occur in a steel sheet that contains Cu. For the above reasons, it is desirable to limit the Ni content to be 0.01% or more. The Ni content is more preferably 0.05% or more and is further preferably 0.10% or more. However, if the Ni content is excessively high, scale may be formed nonuniformly inside the heating furnace and, consequently, the occurrence of surface defect may be induced. In addition, the production costs may be increased significantly. Accordingly, the Ni content is limited to be 1% or less. The Ni content is more preferably 0.50% or less and is further preferably 0.30% or less.

Cr: 0.01% or More and 1.0% or Less

Cr may be added to steel in order to enhance the hardenability of the steel. For achieving the above advantageous effect, the Cr content is preferably adjusted to be 0.01% or more. The Cr content is more preferably 0.05% or more and further preferably 0.10% or more. However, if the Cr content exceeds 1.0%, the rate at which cementite dissolves during annealing is reduced and, consequently, some of the cementite particles may remain undissolved, which may degrade delayed fracture resistance at sheared end surfaces. Moreover, pitting corrosion resistance and phosphatability may become degraded. Accordingly, it is desirable to limit the Cr content to be 0.01% to 1.0%. If the Cr content exceeds 0.2%, delayed fracture resistance, pitting corrosion resistance, and phosphatability may become degraded. Thus, in order to prevent the degradation in these properties, the Cr content is more preferably adjusted to be 0.2% or less.

Mo: 0.01% or More and Less Than 0.3%

Mo may be added to steel in order to enhance the hardenability of steel, to form fine carbide particles that contain Mo, which serve as hydrogen-trapping sites, and to improve delayed fracture resistance by forming fine martensite structure. In the case where large amounts of Nb and Ti are added to steel, coarse Nb and Ti precipitates are formed and degrade delayed fracture resistance on the contrary. Mo has a higher solubility limit than Nb or Ti. In the case where Mo is used in combination with Nb and Ti, Nb and Ti form fine precipitates in combination with Mo and, consequently, fine microstructure may be formed. Thus, adding Mo to steel in combination with small amounts of Nb and Ti enables a large amount of fine carbide particles to be dispersed in the microstructure while inhibiting the formation of coarse precipitates to form a fine microstructure and thereby enhances delayed fracture resistance. For achieving the advantageous effects, it is desirable to limit the Mo content to be 0.01% or more. The Mo content is more preferably 0.03% or more and is further preferably 0.05% or more. However, if the Mo content is 0.3% or more, phosphatability may become degraded. The Mo content is preferably 0.2% or less. Accordingly, is desirable to limit the Mo content to be 0.01% or more and less than 0.3%.

V: 0.003% or More and 0.45% or Less

V may be added to steel in order to enhance the hardenability of steel, to form fine carbide particles that contain V, which serve as hydrogen-trapping sites, and to improve delayed fracture resistance by forming fine martensite structures. For achieving the advantageous effects, it is desirable to limit the V content to be 0.003% or more. The V content is more preferably 0.03% or more and is further preferably 0.05% or more. However, if the V content exceeds 0.45%, castability may become significantly degraded. The V content is more preferably 0.30% or less, is further preferably 0.20% or less, and is most preferably 0.09% or less. Thus, the V content is desirably 0.003% to 0.45%.

Zr: 0.00% or More and 0.2% or Less

Zr reduces the size of prior-γ grains and the sizes of blocks, bain grains, and the like that are units constituting the internal structures of martensite and bainite, thereby increasing the strength of a steel sheet and improving the delayed fracture resistance. Zr also forms fine Zr carbide and carbonitride particles, which serve as hydrogen-trapping sites, thereby increasing the strength of a steel sheet and improving the delayed fracture resistance, Zr also improves castability. For the above reasons, it is desirable to limit the Zr content to be 0.005% or more. The Zr content is more preferably 0.010% or more and is further preferably 0.015% or more. However, if the Zr content is excessively high, the amount of coarse precipitates, such as ZrN and ZrS, that remain undissolved during slab heating in the hot-rolling process is increased and, consequently, delayed fracture resistance at sheared end surfaces may become degraded. Accordingly, the Zr content is desirably 0.2% or less, is more preferably 0.1% or less, and is further preferably 0.04% or less.

W: 0.005% or More and 0.2% or Less

W forms fine W carbide and earbonitride particles, which serve as hydrogen-trapping sites, thereby increasing the strength of the steel sheet and improving the delayed fracture resistance. For the above reasons, it is desirable to limit the W content to be 0.005% or more. The W content is more preferably 0.010% or more and is further preferably 0.030% or more. However, if the W content is excessively high, the amount of coarse precipitates that remain undissolved during slab heating in the hot-rolling process is increased and, consequently, delayed fracture resistance at sheared end surfaces may become degraded. Accordingly, the W content is desirably 0.2% or less and is more preferably 0.1% or less.

Ca: 0.0002% or More and 0.0030% or Less

Ca combines with S to form CaS, thereby fixes S, and improves delayed fracture resistance. For achieving the advantageous effects, it is desirable to limit the Ca content to be 0.0002% or more. The Ca content is more preferably 0.0005% or more and is further preferably 0.0010% or more. However, adding a large amount of Ca to steel may degrade the surface qualities and bendability of the steel sheet. Accordingly, the Ca content is desirably 0.0030% or less. The Ca content is more preferably 0.0025% or less and is further preferably 0.0020% or less.

Ce: 0.0002% or More and 0.0030% or Less

Ce fixes S and thereby improves delayed fracture resistance. For achieving the advantageous effect, it is desirable to limit the Ce content to be 0.0002% or more. The Ce content is more preferably 0.0003% or more and is further preferably 0.0005% or more. However, adding a large amount of Ce to steel may degrade the surface qualities and bendability of the steel sheet. Accordingly, the Ce content is desirably 0.0030% or less. The Ce content is more preferably 0.0020% or less and is further preferably 0.0015% or less.

La: 0.0002% or More and 0.0030% or Less

La fixes S and thereby improves delayed fracture resistance. For achieving the advantageous effect, it is desirable to limit the La content to be 0.0002% or more. The La content is more preferably 0.0005% or more and is further preferably 0.0010% or more. However, adding a large amount of La to steel may degrade the surface qualities and bendability of the steel sheet. Accordingly, the La content is desirably 0.0030% or less. The La content is more preferably 0.0020% or less and is further preferably 0.0015% or less.

Mg: 0.0002% or More and 0 0030% or Less

Mg forms MgO to fix O and thereby improves delayed fracture resistance. For achieving the advantageous effect, it is desirable to limit the Mg content to be 0.0002% or more. The Mg content is more preferably 0.0005% or more and is further preferably 0.0010% or more. However, adding a large amount of Mg to steel may degrade the surface qualities and bendability of the steel sheet. Accordingly, the Mg content is desirably 0.0030% or less. The Mg content is more preferably 0.0020% or less and is further preferably 0.0015% or less.

Sb: 0.002% or More and 0.1% or Less

Sb suppresses the oxidation. and nitridation of the surface layer and thereby limits reductions in the contents of C and B. Since the reductions in the contents of C and B are limited, the formation of ferrite in the surface layer can be suppressed. This increases the strength of the steel sheet and improves the delayed fracture resistance. For the above reasons, the Sb content is desirably 0.002% or more. The Sb content is more preferably 0.004% or more and is further preferably 0.006% or more. However, if the Sb content exceeds 0.1%, castability may become degraded. In addition, Sb may segregate at prior-γ grain boundaries and degrade delayed fracture resistance at sheared end surfaces. Accordingly, the Sb content is desirably 0.1% or less. The Sb content is more preferably 0.05% or less and is further preferably 0.02% or less.

Sn: 0.002% or More and 0.1% or Less

Sn suppresses the oxidation and nitridation of the surface layer and thereby limits reductions in the contents of C and B in the surface layer. Since the reductions in the contents of C and B are limited, the formation of ferrite in the surface layer can be suppressed. This increases the strength of the steel sheet and improves the delayed fracture resistance. For the above reasons, the Sn content is desirably 0.002% or more. The Sn content is preferably 0.003% or more. However, if the Sn content exceeds 0.1%, castability may become degraded. In addition, Sn may segregate at prior-γ grain boundaries and degrade delayed fracture resistance at sheared end surfaces. Accordingly, the Sn content is desirably 0.1% or less. The Sn content is more preferably 0.05% or less and is further preferably 0.01% or less.

Constituents other than the above elements, that is, the balance, includes Fe and inevitable impurities. In the case where the steel sheet according to the disclosed embodiments contains some of the above optional elements at concentrations less than the above lower its, it is considered that the steel sheet includes the optional elements as inevitable impurities.

The microstructure of the steel sheet according to the disclosed embodiments has the following features (Feature 1) The total area fraction of martensite and bainite to the entirety of the microstructure is 95% or more and 100% or less. The balance includes one or two of ferrite and retained austenite.

(Feature 2) The microstructure includes inclusion clusters that satisfy the conditions below, the inclusion clusters having a major axis of 20 to 80 μm. The content of the inclusion clusters in the microstructure is 5 clusters/mm$^2$ or less.

(Conditions)

Each of the inclusion clusters is constituted by one or more inclusion particles. The inclusion particles have a major axis of 0.3 μm or more. In the case where the inclusion clusters are constituted by two or more inclusion particles, the shortest distance between the inclusion particles is 10 μm or less.

(Feature 3) The average size of prior-austenite grains is more than 5 μm.

The above features are described below.

Feature 1

The total area fraction of martensite and bainite in the microstructure is limited to be 95% or more and 100% or less in order to produce a steel sheet having a high TS of 1320 MPa or more and excellent delayed fracture resistance. The above area fraction is more preferably 96% or more and is further preferably 97% or more. If the area fraction is lower than the above limit, the amount of ferrite or retained γ is increased and, consequently, delayed fracture resistance may become degraded. When the steel sheet includes microstructures other than martensite or bainite, the balance includes ferrite and retained γ. The portion of the steel sheet other than the above microstructures is constituted by trace amounts of carbides, sulfides, nitrides, and oxides. The martensite includes martensite that has not been tempered by being held at 150° C. or more for a predetermined amount of time while, for example, the steel sheet is self-tempered during continuous cooling. The microstructure does not necessarily include the balance. That is, the total area fraction of martensite and bainite may be 100%. The ratio of the area traction of martensite to the area fraction of bainite (martensite/bainite) is commonly 0 5 to 2.0.

Feature 2

In the microstructure of the steel sheet according to the disclosed embodiments, the feature 2 is important for enhancing delayed fracture resistance at sheared end surfaces. The microstructure includes inclusion clusters that satisfy the following conditions.

(Conditions)

Each of the inclusion clusters is constituted by one or more inclusion particles. The inclusion particles have a major axis of 0.3 μm or more. In the case where the inclusion clusters are constituted by two or more inclusion particles, the shortest distance between the inclusion particles is 10 μm or less.

The length of the major axis of each of the inclusion particles is 0.3 μm or more. The reason for which particular attention is focused on inclusion particles having a major axis of 0.3 μm or more is that inclusion particles having a size of less than 0.3 μm do not significantly degrade delayed fracture resistance even after they have formed aggregates. The term "length of the major axis" used herein refers to the length of an inclusion particle in the rolling direction.

In the case where the inclusion clusters are constituted by two or more inclusion particles, the shortest distance between the inclusion particles is 10 μm or less. Narrowing down inclusion clusters in this manner enables an appropriate definition of inclusion clusters that affect delayed fracture resistance. Adjusting the number of the inclusion clusters defined as described above per unit area ($mm^2$) improves delayed fracture resistance. In the measurement of shortest distance, inclusion particles present inside a sector of a circle with a center at the edge of an inclusion particle in the longitudinal direction, the two radii of the sector forming an angle of ±10° with respect to the rolling direction, are taken into account (inclusion particles that are partially included in the sector are also taken into account). The term "shortest distance between the inclusion particles" used herein refers to the shortest distance between points on the peripheries of the respective particles.

The shape of the inclusion particles constituting the inclusion clusters and the manner in which the inclusion particles are present are not limited. In the disclosed embodiments, normally, the inclusion particles may be inclusion particles elongated in the rolling direction or inclusion particles distributed in a dotted-line manner in the rolling direction. The term "inclusion particles distributed in a dotted-line manner in the rolling direction" used herein refers to a cluster of two or more inclusion Particles distributed in a dotted-line manner in the rolling direction. The expression "distributed in a dotted-line manner in the rolling direction" means the state similar to the state where, for example, inclusion particles elongated in the rolling direction are divided into pieces in cold rolling to be distributed in a dotted-line manner. Note that the above description is provided for explaining the manner in which the inclusion particles may be present; it is not intended that the manner in which the inclusion particles are present is limited to the state where inclusion particles are divided into pieces in cold rolling to be distributed in a dotted-line manner.

Particular attention is focused on the inclusion clusters defined as described above. The content of the inclusion clusters having a major axis of 20 to 80 μm is adjusted to be 5 clusters/$mm^2$ or less. In the case where the inclusion clusters is constituted by only one inclusion particle, an inclusion particle having a major axis of 20 to 30 μm is considered as one inclusion cluster, and the number of such inclusion clusters per square millimeter is counted.

For enhancing delayed fracture resistance at sheared end surfaces, it is necessary to reduce, by a sufficient degree, the amount of the inclusion clusters composed of MnS, oxides, and nitrides which are included in the region extending from the surface layer to the center of the steel sheet in the thickness direction. For reducing the occurrence of cracking at the sheared end surfaces even in a component produced using a high-strength steel having a TS of 1320 MPa or more, it is necessary to reduce the distribution density of the above-described inclusion clusters to be 5 clusters/$mm^2$ or less. The distribution density of the inclusion clusters is preferably 4 clusters/$mm^2$ or less and is further preferably 0 cluster/$mm^2$.

It is not necessary to focus particular attention on the inclusion clusters having a major axis of less than 20 μm because the negative impacts of such inclusion clusters on delayed fracture resistance are negligible. Particular attention is not focused on the inclusion clusters having a major axis of more than 80 μm because the formation of such inclusion clusters becomes negligible when the S content is limited to be less than 0.0010% (the range of the above composition). The term "length of the major axis" used herein refers to the length of an inclusion cluster in the rolling direction.

Feature 3

The average size of prior-austenite (prior-γ) grains is more than 5 μm. When a steel containing Nb, Ti, and the like is subjected to a hot-rolling step, fine Nb- and Ti-carbonitride particles are formed in the steel. In the subsequent continuous annealing step, prior-γ grain boundaries are pinned with the above precipitates and, consequently, the prior-γ grain size is commonly reduced to 5 μm or less. It has been considered that the reduction in prior-γ grain size is effective for delayed fracture resistance. However, when the inventors charged hydrogen into the steel according to the disclosed embodiments to cause delayed fracture of the steel, the fracture surface of the steel was not formed at the prior-γ grain boundaries but are pseudo-cleavage fracture surface in the case where the hydrogen concentration was within a low range (<0.5 ppm) at which hydrogen enters steel in actual service environment (the hydrogen concentration is volume concentration). Thus, it is considered that the enhancement in delayed fracture resistance due to the addition of Nb and Ti cannot be attributed only to reduction in prior-γ grain size. On the other hand, when the size of prior-γ rains included in a steel containing Nb and Ti was increased intentionally and the resistance of the steel to delayed fracture was determined, it was found that the resistance of the steel to delayed fracture was remarkably improved. Although the mechanisms responsible for this are not clear, the inventors had the following observations. Specifically, addition of Nb causes a change in the texture, which may affect the residual stress at the end surfaces formed by shearing and consequently enhance delayed fracture resistance. It is considered that, while prior-γ grains are grown in the annealing step, the degree of orientation of the texture is increased and, consequently, delayed fracture resistance is remarkably enhanced. Since the advantageous effects became significant when the prior-γ grain size was more than 5 μm, it is necessary to adjust the prior-γ grain size to be more than 5 μm. Although the upper limit for the prior-γ grain size is not specified, it is preferable to adjust the prior-γ grain size to be 20 μm or less in order to prevent degradation in toughness. As for the lower limit, the prior-γ grain size is preferably 7 μm or more and is more preferably 9 μm or more. As for the upper limit, the prior-γ grain size is preferably 18 μm or less and is more preferably 14 μm or less.

The measurement methods used for determining whether or not the features of the microstructure are satisfied are described below.

The total area fraction of martensite and bainite and the area fraction of ferrite were determined by grinding an L-cross section of the steel sheet (the vertical cross section of the steel sheet which is parallel to the rolling direction), etching the L-cross section with nital, observing a portion of the L-cross section which was ¼ the thickness of the steel sheet below the surface with a SEM at a 2000-fold magnification in 4 fields of view, and analyzing the resulting microstructure images. In the SEM images, martensite and bainite are microstructures that appear gray, while ferrite is the region that appears black in contrast. Martensite and bainite include trace amounts of carbide, nitride, sulfide, and oxide. In the calculation of the area fraction of martensite and bainite, the area fraction of regions that include these trace substances was also taken into account because it is difficult to exclude the area fraction of the trace substances. The measurement of retained γ was conducted by grinding a cross section of the steel sheet which was 200 μm below the surface by chemical polishing using oxalic acid and analyzing the cross section by an X-ray diffraction intensity method. The fraction of retained γ was determined using the integrated intensities of peaks of diffraction planes of the (200)α, (211)α, and (220)α and the (200)γ, (220)γ, and (311)γ measured with Mo-$K_\alpha$ radiation.

The size f prior-γ grains was determined by grinding an L-cross section of the steel sheet (the vertical cross section of the steel sheet which is parallel to the rolling direction), etching the L-cross section with a chemical solution used for etching prior-γ grain boundaries (e.g., a saturated aqueous solution of picric acid or a mixture of a saturated aqueous solution of picric acid with ferric chloride), observing a portion of the L-cross section which was ¼ the thickness of the steel sheet below the surface with an optical microscope at a 500-fold magnification in 4 fields of view, drawing 15 straight lines on each of the images in the rolling direction and the direction perpendicular to the rolling direction at intervals of 10 μm or more in actual length, and counting the number of points at which a grain boundary intersects any of the straight lines. The total length of the straight lines was divided by the total number of the intersection points and multiplied by 1.13 to give the size of prior-γ grains.

Whether or not the feature 2 is satisfied is determined by grinding an L-cross section of the steel sheet (the vertical cross section of the steel sheet which is parallel to the rolling direction), and then, without etching the L-cross section, taking an image of 1.2-$mm^2$ region in which the distribution density of the inclusions was on an average, the region being selected from a portion of the L-cross section which extends ⅕t to ⅘t below the surface layer of the steel sheet (t represents the thickness of the steel sheet), that is, a portion of the L-cross section which extends from the position ⅕ the thickness of the steel sheet below the front surface to the position ⅕ the thickness of the steel sheet below the rear surface across the center of the steel sheet in the thickness direction, with a SEM continuously in 30 fields of view. The reason for which the above thickness range is measured is that the inclusion clusters specified in the present application are hardly present in the topmost surface of the steel sheet. This is because the amounts of Mn and S that segregate at the topmost surface of the steel sheet are small and that, while the slab is heated, Mn and S sufficiently dissolve in the topmost surface heated at a high temperature and the likelihood of precipitation of Mn and S is small. The images were taken at a 500-fold magnification. The images taken at a 500-fold magnification were magnified as needed and the length of the major axis of each of the inclusion particles or the inclusion clusters and the distances between the inclusion particles were measured. In the case where it was difficult to determine the length of the major axis and the shortest distance between inclusion particles, the images were magnified 5000-fold. Since inclusions and the like elongated in the rolling direction are targeted, the direction in which the distance (shortest distance) between particles is measured is limited to, as described above, the rolling direction or a direction inclined at an angle of ±10 degrees with respect to the rolling direction. When an inclusion cluster is constituted by two or more inclusion particles, the overall length of the inclusion cluster in the rolling direction (the length of the major axis of the inclusion cluster) is the distance in the rolling direction between an edge of the inclusion particle located at one of the ends of the inclusion cluster in the rolling direction and an edge of the inclusion particle located at the other end of the inclusion cluster, the edges of the inclusion particles facing outward of the inclusion cluster. When an inclusion cluster is constituted by one inclusion particle, the overall length of the inclusion cluster in the rolling direction is the length of the inclusion particle in the rolling direction.

Inclusion particles constituting the inclusion clusters are primarily particles of Mn-, Ti-, Zr-, Ca-, and REM-sulfides, Al-, Ca-, Mg-, Si-, and Na-oxides, Ti-, Zr-, Nb-, and Al-nitrides, Ti-, Nb-, Zr-, and Mo-carbides, and composite precipitates of these substances. Fe carbides are not included in the inclusion particles. Inclusion clusters that are formed in the casting process and subsequently remain undissolved during slab heating are the majority in terms of volume fraction. Some of the inclusion clusters are formed by the above substances reprecipitating with the undissolved inclusion clusters as composite precipitates or by the above substances reprecipitating as a result of coming into contact with the undissolved inclusion clusters during the subsequent hot-rolling, coiling, and annealing processes.

Tensile Strength (TS): 1320 MPa or More

The degradation in delayed fracture resistance at sheared end surfaces becomes significant particularly when the tensile strength of the steel sheet is 1320 MPa or more. One of the features of the disclosed embodiments is that the steel sheet according to the disclosed embodiments has high delayed fracture resistance at the sheared end surfaces even when the steel sheet has a TS of 1320 MPa or more. Accordingly, the steel sheet according to the disclosed embodiments has a tensile strength of 1320 MPa or more. The tensile strength of the steel sheet according to the disclosed embodiments is commonly 2400 MPa or less or 2300 MPa or less.

It is considered that the steel sheet according to the disclosed, embodiments has excellent delayed fracture resistance when, in the evaluation of delayed fracture property described in Examples, no crack is formed in the case where the steel sheet has a TS of less than 1560 MPa; when the delayed-fracture time is $10^{(-0.008\times(TS-1760)+0.69)}$ or more in the case where the steel sheet has a TS of 1560 MPa or more and 1910 MPa or less; and when the delayed-fracture time is 0.3 hr or more in the case where the steel sheet has a TS of more than 1910 MPa.

The yield strength (YP) of the steel sheet is commonly 1000 MPa or more and 2000 MPa or less, and the total elongation. (El) of the steel sheet is commonly 5% or more and 10% or less, although these limitation not necessary for addressing the issues of the disclosed embodiments.

The above-described steel sheet according to the disclosed embodiments may be provided with a coating layer deposited on the surface. The type of the coating layer is not limited and may be a Zn-coating layer or a coating layer composed of a metal other than Zn. The coating layer may include a constituent other than the main constituent, such as Zn. In the disclosed embodiments, the coating layer is preferably a hot-dip galvanizing layer or an alloyed hot-dip galvanizing layer.

The method for producing the steel sheet according to the disclosed embodiments is described below. The method for producing a steel sheet according to the disclosed embodiments includes holding a steel slab having the above-described composition for 100 minutes or more with a slab-surface temperature of 1220° C. or more and subsequently hot-rolling the steel slab into a hot-rolled steel sheet; cold-rolling the hot-rolled steel sheet into a cold-rolled steel sheet at a cold-rolling ratio of 40% or more; and performing continuous annealing of the cold-rolled steel sheet, the continuous annealing including treating the cold-rolled steel sheet for 240 seconds or more with an annealing temperature higher than 850° C., subsequently reducing the temperature from 680° C. or more to 260° C. or less at an average cooling rate of 70° C./s or more, then performing reheating as needed, and subsequently performing holding at 150° C. to 260° C. for 20 to 1500 seconds.

Hot Rolling

Examples of the method of hot-rolling a steel slab include a method in which the slab is heated and subsequently rolled; a method in which a slab formed by continuous casting is directly rolled without being heated; and a method in which a slab formed by continuous casting is heated for a short period of time and subsequently rolled. In hot rolling, it is important to set the slab-surface temperature to 1220° C. or more and the holding time to 100 minutes or more. This facilitates the dissolution of sulfides and thereby reduces the sizes and numbers of the inclusion clusters. The slab-surface temperature is preferably 1350° C. or less. The holding time is 250 minutes or less. As in the conventional methods, the average heating rate during slab heating may be 5 to 15° C./min, the finishing temperature FT may be 840° C. to 950° C., and the coiling temperature CT may be 400° C. to 700° C.

It is desirable to perform descaling to a sufficient degree in order to remove primary scale and secondary scale formed on the surface of the steel sheet. It is preferable to perform descaling with a high impact pressure of 500 MPa or more. Such a descaling treatment reduces the amount of red scale that regains on the steel sheet and the thickness of the secondary scale formed on the steel sheet, thereby limiting the likelihood of oxygen included in the scale entering the steel sheet during coiling and reducing the oxidation of the surface of the steel sheet caused by the oxygen. As a result, the thickness of an oxide layer formed on the surface of the final product can be reduced. This enhances the corrosion resistance of the steel sheet. Moreover, it becomes possible to limit reductions in the contents of C and B in the vicinity of the surface layer which are caused as a result of oxidation of C and B in the surface layer. This suppresses the formation of ferrite in the surface layer in the CAL annealing and improves delayed fracture resistance at sheared end surfaces. It is advantageous to sufficiently pickle the hot-rolled coil prior to cold rolling in order to reduce the amount of remaining scale. Optionally, the hot-rolled steel sheet may be annealed in order to reduce the load required for cold rolling.

Cold Rolling

When the rolling reduction ratio in cold rolling (cold-rolling ratio) is set to 40% or more, the recrystallization and texture orientation that occur in the subsequent continuous annealing step can be stabilized. If the cold-rolling ratio is less than 40%, some of the austenite grains may become coarsened during annealing and, consequently, the strength of the steel sheet may be reduced. The cold-rolling ratio is preferably 80% or less.

Continuous Annealing

The cold-rolled steel sheet is subjected to annealing in a CAL and subsequently tempered and temper-rolled as needed.

It is effective to increase the annealing temperature for increasing the size of prior-γ grains. In the case where a steel having the composition according to the disclosed embodiments is used, it is necessary, at least, to set the annealing temperature to more than 850° C. and the soaking time to 240 seconds or more for increasing the size of prior-γ grains to be more than 5 μm. However, if the size of prior-γ grains exceeds 20 μm, toughness may become degraded. Thus, it is preferable to set the annealing temperature to 940° C. or less and the soaking time to 900 seconds or less. The soaking time is more preferably 600 seconds or less.

For reducing the amount of ferrite and retained γ and adjusting the area fraction of martensite and bainite to be 95% or more, it is necessary to reduce the temperature from a high temperature of 680° C. or more to 260° C. or less at an average cooling rate of 70° C./s or more (rapid cooling). The average cooling rate is preferably 700° C./s or more. If the rapid cooling is started at a temperature lower than the above temperature, a large amount of ferrite may be formed. In addition, carbon may concentrate at γ. This lowers the Ms point and increases the amount of untempered martensite (fresh martensite). If the cooling rate is low, upper and lower bainite may be formed, and the amount of retained γ and fresh martensite may be increased accordingly. If the cooling-stop temperature is higher than 260° C., upper and lower bainite may be formed, and the amount of retained y and fresh martensite may be increased accordingly. The acceptable limit for the area fraction of fresh martensite to martensite is 5% with 100 being the amount of martensite. The amount of fresh martensite falls within the above range when the above-described conditions are employed. As for the upper limit for the cooling-start temperature, the cooling-start temperature is preferably 940° C. or less. As for the lower limit for the cooling-stop temperature, the cooling-stop temperature is preferably 150° C. or more. As for the upper limit for the average cooling rate, the average cooling rate is preferably 1000° C./s or less The carbide particles distributed inside martensite and bainite are carbide particles formed while holding is performed at low temperatures subsequent to quenching. For achieving high delayed fracture resistance and a TS of 1.320 MPa or more, it is necessary to appropriately control the formation of the above carbide particles. Specifically, the temperature at which reheating and holding are performed after quenching to about room temperature or the cooling-stop temperature subsequent to the rapid cooling needs to be set to 150° C. to 260° C. and the holding time needs to be set to 20 to 1500 seconds. If the temperature is lower than the above limit or the holding time is shorter than the above limit, the density at which the carbide particles are distributed inside the transformation phase may fail to be sufficiently high and, consequently, delayed fracture resistance may become degraded. If the temperature is higher than the above limit, the coarsening of the carbide particles becomes significant inside the grains and at the block grain boundaries and, consequently, delayed fracture resistance may become degraded.

The steel sheet may be optionally subjected to skin pass rolling in order to enhance consistency in press formability, that is, for example, to adjust the surface roughness of the steel sheet and increase the flatness and smoothness of the steel sheet. In such a case, the skin-pass elongation is preferably 0.1% to 0.6%. In skin pass rolling, it is preferable to use a dull roll as a skin pass roll and adjust the roughness Ra of the steel sheet to be 0.8 to 1.8 μm in order to increase the flatness and smoothness of the steel sheet.

The steel sheet may optionally be subjected to coating. Coating of the steel sheet produces a steel sheet provided with a coating layer deposited on the surface thereof. The type of coating is not limited; any of hot-dip coating and electroplating may be used. Alloying may be performed subsequent to hot-dip coating. In the case where both coating and skin pass rolling are performed, skin pass rolling is performed subsequent to coating.

EXAMPLES

Each of the steels having the compositions shown Table 1 was prepared and cast into a slab. Note that, in the column "[% Ti]×[% Nb]$^2$" in Table 1, "E-[Numeral]" refers to 10 raised to the power of −[Numeral]. For example, "E-07" refers to $10^{-7}$. The unit of "[% Ti]×[% Nb]$^2$" shown in Table 1 is (mass %)$^3$.

Each of the slabs, except for some of Comparative steels described below, was coiled under the following conditions as shown in Table 2: slab-heating temperature (SRT): 1220° C. or more, holding time: 100 minutes or more, finishing temperature (FT): 840° C. to 950° C., coiling temperature (CT): 400° C. to 700° C. The resulting hot-rolled sheet (hot-rolled steel sheet) was pickled and then cold-rolled at a rolling reduction of 40% or more into a cold-rolled sheet (cold-rolled steel sheet). In No. 41, the slab-heating temperature was outside the above range. In No. 42, the heating time was outside the above range. In No. 43, rolling reduction for cold rolling was outside the above range.

In the continuous annealing step, each of the cold-rolled sheets, except for some of Comparative steels described below, was soaked at an annealing temperature (AT) higher than 850° C. for 240 sec or more, then cooled from 680° C. or more to 260° C. or less at an average cooling rate of 70° C./s or more, and subsequently held at 150° C. to 260° C. for 20 to 1500 seconds (some of the samples were reheated and the others were held at a cooling-stop temperature of 150° C. to 260° C.) as shown in Table 2. The steel sheets were then temper-rolled at an elongation of 0.1% to form steel sheets having a thickness of 1.4 mm. In No. 44, the annealing temperature was outside the above range. In No. 48, the soaking time was outside the above range. In No. 49, the cooling-start temperature was outside the above range. In No. 51, the cooling-stop temperature was outside the above range.

TABLE 1

| Steel No. | Composition* | | | | | | | | | | | | | | Remark |
|---|---|---|---|---|---|---|---|---|---|---|---|---|---|---|---|
| | C | Si | Mn | P | S | sol.Al | N | O | B | Nb | Ti | [% Ti] + [% Nb] | [% Ti] × [% Nb]$^2$ | others | |
| A | 0.13 | 1.40 | 1.1 | 0.019 | 0.0007 | 0.039 | 0.0035 | 0.0012 | tr | 0.010 | 0.005 | 0.015 | 5.1E−07 | — | Conforming steel |
| B | 0.32 | 1.19 | 1.3 | 0.028 | 0.0002 | 0.028 | 0.0030 | 0.0021 | tr | 0.013 | 0.013 | 0.026 | 2.1E−06 | — | Conforming steel |
| C | 0.31 | 1.40 | 0.7 | 0.025 | 0.0006 | 0.049 | 0.0036 | 0.0025 | tr | 0.026 | 0.010 | 0.036 | 6.9E−06 | — | Conforming steel |
| D | 0.21 | 1.24 | 1.6 | 0.026 | 0.0003 | 0.025 | 0.0034 | 0.0008 | tr | 0.011 | 0.035 | 0.046 | 4.2E−06 | — | Conforming steel |
| E | 0.14 | 0.27 | 1.3 | 0.029 | 0.0007 | 0.032 | 0.0048 | 0.0025 | tr | 0.028 | 0.006 | 0.034 | 4.4E−06 | — | Conforming steel |
| F | 0.29 | 0.42 | 0.8 | 0.008 | 0.0009 | 0.030 | 0.0043 | 0.0005 | tr | 0.018 | 0.006 | 0.024 | 2.0E−06 | — | Conforming steel |
| G | 0.18 | 0.76 | 1.2 | 0.020 | 0.0002 | 0.040 | 0.0026 | 0.0007 | tr | 0.010 | 0.020 | 0.030 | 2.0E−06 | — | Conforming steel |
| H | 0.21 | 0.77 | 0.5 | 0.027 | 0.0008 | 0.033 | 0.0036 | 0.0018 | 0.0034 | 0.015 | 0.020 | 0.035 | 4.6E−06 | — | Conforming steel |
| I | 0.22 | 0.15 | 1.4 | 0.024 | 0.0007 | 0.046 | 0.0027 | 0.0008 | 0.0003 | 0.004 | 0.024 | 0.028 | 4.5E−07 | — | Conforming steel |
| J | 0.19 | 1.43 | 1.5 | 0.027 | 0.0003 | 0.040 | 0.0042 | 0.0014 | 0.0028 | 0.034 | 0.005 | 0.039 | 5.8E−06 | — | Conforming steel |
| K | 0.18 | 1.02 | 0.7 | 0.017 | 0.0005 | 0.029 | 0.0042 | 0.0019 | 0.0021 | 0.003 | 0.036 | 0.039 | 3.2E−07 | — | Conforming steel |
| L | 0.30 | 0.80 | 1.5 | 0.009 | 0.0003 | 0.023 | 0.0048 | 0.0023 | 0.0020 | 0.008 | 0.038 | 0.046 | 2.4E−06 | — | Conforming steel |
| M | 0.21 | 0.87 | 0.5 | 0.026 | 0.0002 | 0.042 | 0.0014 | 0.0015 | 0.0032 | 0.028 | 0.002 | 0.030 | 1.5E−06 | — | Conforming steel |
| N | 0.19 | 0.30 | 1.3 | 0.021 | 0.0004 | 0.040 | 0.0018 | 0.0021 | 0.0029 | 0.004 | 0.027 | 0.031 | 4.7E−07 | Cu: 0.19 | Conforming steel |
| O | 0.32 | 1.33 | 1.0 | 0.002 | 0.0008 | 0.043 | 0.0024 | 0.0024 | 0.0027 | 0.008 | 0.016 | 0.024 | 1.0E−06 | Ni: 0.14 | Conforming steel |
| P | 0.32 | 0.34 | 1.0 | 0.011 | 0.0005 | 0.038 | 0.0035 | 0.0023 | 0.0009 | 0.017 | 0.021 | 0.038 | 6.2E−06 | Mo: 0.05 | Conforming steel |
| Q | 0.29 | 0.66 | 1.4 | 0.023 | 0.0002 | 0.021 | 0.0023 | 0.0010 | 0.0026 | 0.013 | 0.022 | 0.035 | 3.7E−06 | Mo: 0.12, Ce: 0.0005 | Conforming steel |
| R | 0.16 | 0.31 | 0.4 | 0.004 | 0.0006 | 0.047 | 0.0018 | 0.0005 | 0.0011 | 0.012 | 0.003 | 0.015 | 4.3E−07 | Mo: 0.05, V: 0.05 | Conforming steel |
| S | 0.24 | 1.48 | 1.6 | 0.003 | 0.0004 | 0.036 | 0.0018 | 0.0006 | 0.0006 | 0.021 | 0.015 | 0.036 | 6.6E−06 | Mo: 0.1, V: 0.05 | Conforming steel |
| T | 0.25 | 1.23 | 1.1 | 0.018 | 0.0007 | 0.021 | 0.0019 | 0.0020 | 0.0026 | 0.013 | 0.033 | 0.046 | 5.6E−06 | Ca: 0.0012, Cr: 0.18, Mo: 0.005 | Conforming steel |
| U | 0.22 | 1.36 | 1.7 | 0.013 | 0.0004 | 0.036 | 0.0039 | 0.0005 | 0.0027 | 0.022 | 0.010 | 0.032 | 4.8E−06 | Sb: 0.006, La: 0.001 | Conforming steel |
| V | 0.34 | 1.26 | 1.6 | 0.008 | 0.0006 | 0.021 | 0.0018 | 0.0011 | 0.0018 | 0.006 | 0.014 | 0.020 | 4.6E−07 | Zr: 0.002, Sn: 0.003 | Conforming steel |
| W | 0.18 | 0.39 | 1.1 | 0.021 | 0.0003 | 0.029 | 0.0009 | 0.0022 | 0.0021 | 0.011 | 0.008 | 0.019 | 1.0E−06 | Ca: 0.0003, V: 0.12, W: 0.005 | Conforming steel |
| X | 0.23 | 0.94 | 0.6 | 0.018 | 0.0008 | 0.026 | 0.0039 | 0.0013 | 0.0014 | 0.015 | 0.018 | 0.033 | 4.1E−06 | Ce: 0.001, Zr: 0.002, Mg: 0.001 | Conforming steel |
| Y | 0.12 | 0.68 | 0.5 | 0.025 | 0.0004 | 0.032 | 0.0011 | 0.0014 | 0.0022 | 0.023 | 0.004 | 0.027 | 2.1E−06 | — | Comparative steel |
| Z | 0.42 | 0.47 | 0.5 | 0.012 | 0.0007 | 0.048 | 0.0023 | 0.0023 | 0.0031 | 0.032 | 0.004 | 0.035 | 3.9E−06 | — | Comparative steel |
| AA | 0.29 | 1.60 | 0.5 | 0.015 | 0.0006 | 0.046 | 0.0037 | 0.0006 | 0.0017 | 0.014 | 0.008 | 0.022 | 1.5E−06 | — | Comparative steel |
| AB | 0.35 | 1.21 | 1.8 | 0.018 | 0.0007 | 0.033 | 0.0024 | 0.0006 | 0.0021 | 0.015 | 0.027 | 0.042 | 6.1E−06 | — | Comparative steel |
| AC | 0.30 | 1.11 | 0.4 | 0.034 | 0.0009 | 0.021 | 0.0034 | 0.0019 | 0.0029 | 0.012 | 0.031 | 0.043 | 4.5E−06 | — | Comparative steel |
| AD | 0.24 | 0.56 | 1.6 | 0.011 | 0.0010 | 0.026 | 0.0038 | 0.0024 | 0.0013 | 0.024 | 0.013 | 0.037 | 7.5E−06 | — | Comparative steel |
| AE | 0.36 | 0.62 | 1.2 | 0.018 | 0.0002 | 0.212 | 0.0028 | 0.0023 | 0.0020 | 0.018 | 0.012 | 0.030 | 3.9E−06 | — | Comparative steel |
| AF | 0.15 | 0.70 | 1.3 | 0.018 | 0.0008 | 0.048 | 0.0058 | 0.0020 | 0.0023 | 0.020 | 0.012 | 0.032 | 4.8E−06 | — | Comparative steel |
| AG | 0.20 | 0.52 | 1.5 | 0.009 | 0.0003 | 0.021 | 0.0013 | 0.0028 | 0.0010 | 0.019 | 0.016 | 0.034 | 5.5E−06 | — | Comparative steel |
| AH | 0.22 | 0.56 | 0.6 | 0.024 | 0.0005 | 0.030 | 0.0045 | 0.0023 | 0.0038 | 0.010 | 0.028 | 0.038 | 2.8E−06 | — | Comparative steel |
| AI | 0.26 | 0.77 | 0.4 | 0.021 | 0.0006 | 0.026 | 0.0040 | 0.0022 | 0.0008 | 0.001 | 0.020 | 0.021 | 2.0E−08 | — | Comparative steel |
| AJ | 0.23 | 0.45 | 1.2 | 0.024 | 0.0007 | 0.034 | 0.0027 | 0.0012 | 0.0004 | 0.037 | 0.012 | 0.049 | 1.6E−05 | — | Comparative steel |
| AK | 0.32 | 0.23 | 0.6 | 0.022 | 0.0004 | 0.035 | 0.0025 | 0.0019 | 0.0020 | 0.010 | 0.001 | 0.011 | 1.0E−07 | — | Comparative steel |
| AL | 0.28 | 0.16 | 0.5 | 0.019 | 0.0006 | 0.029 | 0.0051 | 0.0023 | 0.0002 | 0.016 | 0.042 | 0.058 | 1.1E−05 | — | Comparative steel |
| AM | 0.21 | 0.20 | 1.2 | 0.014 | 0.0006 | 0.030 | 0.0032 | 0.0018 | 0.0022 | 0.022 | 0.019 | 0.041 | 9.2E−06 | — | Comparative steel |
| AN | 0.19 | 0.40 | 1.3 | 0.015 | 0.0007 | 0.025 | 0.0040 | 0.0020 | 0.0015 | 0.004 | 0.002 | 0.006 | 3.2E−08 | — | Comparative steel |

The underlined items are outside the range specified in the disclosed embodiments.

*In composition, the contents of the elements are in mass %

TABLE 2

| | | Hot rolling conditions | | Cold rolling conditions | Annealing conditions | | | | | | | |
|---|---|---|---|---|---|---|---|---|---|---|---|---|
| No. | Steel No. | SRT (° C.) | Heating time (min) | Rolling reduction (%) | AT (° C.) | Soaking time (s) | Cooling-start temperature (° C.) | Cooling rate (° C./s) | Cooling-stop temperature (° C.) | Holding temperature (° C.) | Holding time (s) | Remark |
| 1 | A | 1260 | 150 | 60 | 890 | 390 | 760 | 813 | 30 | 190 | 780 | Conforming steel |
| 2 | B | 1260 | 150 | 60 | 880 | 410 | 750 | 800 | 30 | 183 | 820 | Conforming steel |
| 3 | C | 1260 | 150 | 60 | 930 | 300 | 800 | 867 | 30 | 224 | 600 | Conforming steel |
| 4 | D | 1260 | 150 | 60 | 900 | 360 | 770 | 827 | 30 | 192 | 720 | Conforming steel |
| 5 | E | 1280 | 110 | 50 | 880 | 410 | 750 | 800 | 32 | 152 | 820 | Conforming steel |
| 6 | F | 1280 | 110 | 50 | 860 | 480 | 730 | 773 | 32 | 217 | 960 | Conforming steel |
| 7 | G | 1280 | 110 | 50 | 910 | 340 | 780 | 840 | 32 | 208 | 680 | Conforming steel |
| 8 | H | 1280 | 110 | 50 | 930 | 300 | 800 | 867 | 32 | 207 | 600 | Conforming steel |
| 9 | I | 1300 | 100 | 40 | 855 | 500 | 725 | 767 | 34 | 189 | 1000 | Conforming steel |
| 10 | J | 1300 | 100 | 40 | 960 | 250 | 830 | 907 | 34 | 235 | 500 | Conforming steel |
| 11 | K | 1230 | 180 | 60 | 930 | 290 | 800 | 867 | 28 | 175 | 580 | Conforming steel |
| 12 | L | 1230 | 180 | 60 | 860 | 480 | 730 | 773 | 28 | 237 | 960 | Conforming steel |
| 13 | M | 1230 | 180 | 60 | 910 | 340 | 780 | 840 | 28 | 215 | 680 | Conforming steel |
| 14 | N | 1230 | 180 | 60 | 870 | 440 | 740 | 787 | 28 | 209 | 880 | Conforming steel |
| 15 | O | 1230 | 180 | 60 | 890 | 390 | 760 | 813 | 28 | 235 | 780 | Conforming steel |
| 16 | P | 1220 | 200 | 55 | 890 | 390 | 760 | 813 | 31 | 158 | 780 | Conforming steel |
| 17 | Q | 1220 | 200 | 55 | 860 | 480 | 730 | 773 | 31 | 249 | 960 | Conforming steel |
| 18 | R | 1220 | 200 | 55 | 900 | 360 | 770 | 827 | 31 | 191 | 720 | Conforming steel |
| 19 | S | 1340 | 100 | 55 | 895 | 370 | 765 | 820 | 32 | 170 | 740 | Conforming steel |
| 20 | T | 1340 | 100 | 55 | 900 | 360 | 770 | 827 | 32 | 188 | 720 | Conforming steel |
| 21 | U | 1340 | 100 | 55 | 890 | 390 | 760 | 813 | 32 | 238 | 780 | Conforming steel |
| 22 | V | 1230 | 180 | 45 | 880 | 410 | 750 | 800 | 30 | 256 | 820 | Conforming steel |
| 23 | W | 1230 | 180 | 45 | 890 | 380 | 760 | 813 | 30 | 189 | 760 | Conforming steel |
| 24 | X | 1230 | 180 | 45 | 900 | 360 | 770 | 827 | 30 | 226 | 720 | Conforming steel |
| 25 | Y | 1260 | 180 | 60 | 930 | 290 | 800 | 867 | 30 | 170 | 580 | Comparative steel |
| 26 | Z | 1260 | 180 | 60 | 880 | 410 | 750 | 800 | 30 | 215 | 820 | Comparative steel |
| 27 | AA | 1260 | 180 | 60 | 960 | 240 | 830 | 907 | 30 | 244 | 480 | Comparative steel |
| 28 | AB | 1260 | 180 | 60 | 880 | 410 | 750 | 800 | 30 | 210 | 820 | Comparative steel |
| 29 | AC | 1260 | 180 | 60 | 920 | 320 | 790 | 853 | 30 | 233 | 640 | Comparative steel |
| 30 | AD | 1260 | 180 | 60 | 860 | 480 | 730 | 773 | 31 | 225 | 960 | Comparative steel |
| 31 | AE | 1260 | 180 | 60 | 880 | 430 | 750 | 800 | 31 | 212 | 860 | Comparative steel |
| 32 | AF | 1280 | 110 | 55 | 930 | 300 | 800 | 867 | 28 | 203 | 600 | Comparative steel |
| 33 | AG | 1280 | 110 | 55 | 930 | 300 | 800 | 867 | 28 | 238 | 600 | Comparative steel |
| 34 | AH | 1280 | 110 | 55 | 880 | 420 | 750 | 800 | 28 | 244 | 840 | Comparative steel |
| 35 | AI | 1280 | 110 | 55 | 880 | 420 | 750 | 800 | 29 | 205 | 840 | Comparative steel |
| 36 | AJ | 1280 | 110 | 55 | 880 | 410 | 750 | 800 | 29 | 175 | 820 | Comparative steel |
| 37 | AK | 1280 | 110 | 55 | 930 | 300 | 800 | 867 | 29 | 174 | 600 | Comparative steel |
| 38 | AL | 1280 | 110 | 55 | 930 | 300 | 800 | 867 | 30 | 221 | 600 | Comparative steel |
| 39 | AM | 1280 | 110 | 55 | 930 | 300 | 800 | 867 | 30 | 243 | 600 | Comparative steel |
| 40 | AN | 1280 | 110 | 55 | 930 | 300 | 800 | 867 | 30 | 184 | 600 | Comparative steel |
| 41 | N | 1210 | 100 | 60 | 900 | 360 | 770 | 827 | 30 | 233 | 720 | Comparative steel |
| 42 | N | 1280 | 90 | 60 | 900 | 360 | 770 | 827 | 30 | 193 | 720 | Comparative steel |
| 43 | N | 1280 | 110 | 35 | 855 | 360 | 770 | 827 | 30 | 202 | 720 | Comparative steel |
| 44 | N | 1260 | 150 | 60 | 845 | 400 | 715 | 753 | 30 | 152 | 800 | Comparative steel |
| 45 | N | 1260 | 150 | 60 | 980 | 400 | 850 | 933 | 30 | 171 | 800 | Conforming steel |
| 46 | H | 1260 | 150 | 60 | 900 | 880 | 770 | 827 | 30 | 175 | 800 | Conforming steel |
| 47 | H | 1260 | 150 | 60 | 900 | 960 | 770 | 827 | 30 | 259 | 800 | Conforming steel |
| 48 | H | 1260 | 150 | 60 | 900 | 220 | 770 | 827 | 30 | 154 | 440 | Comparative steel |
| 49 | H | 1260 | 150 | 60 | 900 | 360 | 670 | 693 | 30 | 221 | 720 | Comparative steel |
| 50 | Q | 1260 | 150 | 60 | 880 | 360 | 750 | 120 | 250 | 245 | 720 | Conforming steel |
| 51 | Q | 1260 | 150 | 60 | 880 | 360 | 750 | 800 | 280 | 210 | 720 | Comparative steel |
| 52 | V | 1260 | 150 | 60 | 890 | 360 | 760 | 813 | 30 | 182 | 1400 | Conforming steel |
| 53 | V | 1260 | 150 | 60 | 890 | 360 | 760 | 813 | 30 | 176 | 30 | Conforming steel |
| 54 | V | 1260 | 150 | 60 | 890 | 360 | 760 | 80 | 30 | 239 | 720 | Conforming steel |

The underlined items are outside the range specified in the disclosed embodiments.

The metal microstructure of each of the steel sheets was determined by the above-described methods and subjected to a tensile test and a test for evaluating delayed fracture resistance.

In the tensile test, a JIS No. 5 tensile test piece was taken from each of the coils at the position ¼ the width of the coil from an edge of the coil in the width direction such that the direction perpendicular to the rolling direction was equal to the longitudinal direction of the test piece, the test piece was subjected to a tensile test (conforming to JIS Z2241), and the YP, TS, and El of the test piece were measured.

The evaluation of the resistance of each of the steel sheets to delayed fracture was made in the following manner. Specifically, a strip-like specimen was taken from each of the steel sheets at the position ¼ the width of the coil from an edge of the coil in the width direction such that the length of the specimen was 100 mm in the direction perpendicular to the rolling direction and 30 mm in the rolling direction. The side surfaces of the specimen which had a length of 100 mm were formed by shearing. The specimen was subjected to a bending work directly subsequent to shearing (without being machined to remove burrs) such that the burrs faced the outer peripheral surface of the bent specimen. The specimen was fixed with bolts such that the shape of the specimen during the bending work was maintained. In the shearing work, the clearance was set to 13% and the rake angle was set to 2 degrees. The bending work was done with a bend radius that satisfied R/t=2.5, where R represents the bend radius and t represents the thickness of the steel sheet (e.g., when the thickness t of the steel sheet is 2.0 mm, the bending work is done with a punch having a punch tip radius of 5.0 mm) such that the inside angle of the tip was 90 degrees (V-bend). The punch used was a U-shaped punch having a tip with the above radius (a punch including a semicircular tip R and a body having a thickness of 2R). The die used had a corner R of 30 mm. The steel sheet was formed into shape such that the angle of the bending was 90 degrees (V-shape) by adjusting the depth the punch was pressed against the steel sheet. The specimen was pinched and tightly fixed using a hydraulic jack such that the distance between the straight flanged ends of the specimen was equal to that of the specimen bent during the bending work (such that an increase in the gap between the straight portions of the specimen due to springback was cancelled out) and then fixed by bolts. The bolts used for fixing the specimen were attached to the specimen before use so as to penetrate through oval holes (minor axis: 10 mm, major axis: 15 mm) formed in the strip-like specimen at positions 10 mm from the respective short-side edges. The specimen fixed with the bolts was immersed in a 1 liter or more per specimen of hydrochloric acid (aqueous hydrogen chloride solution) having a pH of 1. While the temperature of the aqueous solution was set to 25° C. and the pH of the aqueous solution was controlled to be constant, the test was conducted. The presence of microcracks (initial state of delayed fracture) that were visually identifiable (having a length of about 1 mm) was determined visually or using a camera on a regular basis. The amount of time that elapsed from the start of the immersion of the specimen until the formation of microcracks was measured as the delayed-fracture time. The specimen was evaluated as "no fracture" when the fracture of the specimen was not confirmed even after a lapse of 200 hours since the start of immersion of the specimen.

Table 3 summarizes the results.

FIG. 1 illustrates the relationship between TS and the delayed-fracture time shown in Table 3. The steels in which no crack was formed even after a lapse of 200 hours are denoted by the up-arrows.

TABLE 3

| | | Microstructure | | | | Mechanical properties | | | Delayed fracture resistance | |
|---|---|---|---|---|---|---|---|---|---|---|
| No. | Steel No. | Area fraction of martensite and bainite (%) | Area fraction of balance (%) | Number of inclusion clusters per mm$^2$ (clusters/mm$^2$) | Average prior-γ gain size (μm) | YP (MPa) | TS (MPa) | El (%) | Delayed-fracture time (hr) | Remark |
| 1 | A | 100 | 0 | 1 | 9.2 | 1161 | 1365 | 8 | No fracture | Example |
| 2 | B | 100 | 0 | 1 | 10.1 | 1714 | 1947 | 6 | 0.6 | Example |
| 3 | C | 100 | 0 | 4 | 12.0 | 1701 | 1837 | 7 | 3.2 | Example |
| 4 | D | 100 | 0 | 2 | 10.3 | 1403 | 1627 | 7 | No fracture | Example |
| 5 | E | 100 | 0 | 2 | 8.7 | 1069 | 1364 | 8 | No fracture | Example |
| 6 | F | 100 | 0 | 1 | 7.6 | 1543 | 1729 | 7 | 27.6 | Example |
| 7 | G | 100 | 0 | 1 | 10.6 | 1258 | 1430 | 8 | No fracture | Example |
| 8 | H | 100 | 0 | 2 | 11.8 | 1325 | 1490 | 8 | No fracture | Example |
| 9 | I | 100 | 0 | 1 | 7.5 | 1317 | 1560 | 7 | No fracture | Example |
| 10 | J | 100 | 0 | 4 | 14.2 | 1375 | 1474 | 8 | No fracture | Example |
| 11 | K | 100 | 0 | 2 | 11.7 | 1252 | 1477 | 8 | No fracture | Example |
| 12 | L | 100 | 0 | 2 | 8.1 | 1642 | 1815 | 7 | 5.0 | Example |
| 13 | M | 100 | 0 | 2 | 10.4 | 1337 | 1497 | 7 | No fracture | Example |
| 14 | N | 100 | 0 | 2 | 8.0 | 1246 | 1447 | 8 | No fracture | Example |
| 15 | O | 100 | 0 | 2 | 9.7 | 1738 | 1871 | 6 | 2.2 | Example |
| 16 | P | 100 | 0 | 4 | 9.6 | 1610 | 1892 | 6 | 0.8 | Example |
| 17 | Q | 100 | 0 | 3 | 8.0 | 1602 | 1742 | 7 | 9.1 | Example |
| 18 | R | 100 | 0 | 2 | 10.0 | 1118 | 1321 | 8 | No fracture | Example |
| 19 | S | 100 | 0 | 4 | 10.4 | 1511 | 1766 | 7 | 15.1 | Example |
| 20 | T | 100 | 0 | 3 | 10.1 | 1503 | 1733 | 7 | 19.6 | Example |
| 21 | U | 100 | 0 | 3 | 9.9 | 1465 | 1602 | 7 | No fracture | Example |
| 22 | V | 100 | 0 | 2 | 10.2 | 1821 | 1920 | 6 | 0.6 | Example |
| 23 | W | 100 | 0 | 2 | 9.4 | 1211 | 1421 | 8 | No fracture | Example |
| 24 | X | 100 | 0 | 3 | 10.0 | 1412 | 1563 | 7 | No fracture | Example |
| 25 | Y | 100 | 0 | 0 | 11.8 | 1031 | 1252 | 8 | No fracture | Comparative example |
| 26 | Z | 100 | 0 | 1 | 9.0 | 1928 | 2160 | 6 | 0.1 | Comparative example |
| 27 | AA | 100 | 0 | 0 | 13.7 | 1661 | 1727 | 7 | 2.6 | Comparative example |
| 28 | AB | 100 | 0 | 6 | 10.5 | 1835 | 2037 | 6 | 0.1 | Comparative example |
| 29 | AC | 100 | 0 | 1 | 11.1 | 1634 | 1769 | 7 | 0.9 | Comparative example |
| 30 | AD | 100 | 0 | 15 | 7.8 | 1439 | 1624 | 7 | 0.3 | Comparative example |
| 31 | AE | 100 | 0 | 11 | 9.4 | 1785 | 1972 | 6 | 0.0 | Comparative example |
| 32 | AF | 100 | 0 | 8 | 11.8 | 1165 | 1333 | 8 | 20.3 | Comparative example |
| 33 | AG | 100 | 0 | 6 | 12.0 | 1317 | 1428 | 8 | 56.0 | Comparative example |
| 34 | AH | 100 | 0 | 1 | 8.6 | 1352 | 1490 | 8 | 135.0 | Comparative example |
| 35 | AI | 100 | 0 | 0 | 8.6 | 1470 | 1671 | 7 | 14.5 | Comparative example |
| 36 | AJ | 100 | 0 | 31 | 5.3 | 1365 | 1635 | 7 | 1.2 | Comparative example |
| 37 | AK | 100 | 0 | 0 | 11.8 | 1589 | 1788 | 7 | 0.9 | Comparative example |
| 38 | AL | 100 | 0 | 9 | 5.5 | 1479 | 1642 | 7 | 3.5 | Comparative example |
| 39 | AM | 100 | 0 | 7 | 11.8 | 1306 | 1415 | 8 | 19.1 | Comparative example |
| 40 | AN | 100 | 0 | 1 | 11.8 | 1246 | 1427 | 8 | 70.0 | Comparative example |
| 41 | N | 100 | 0 | 8 | 9.9 | 1256 | 1393 | 8 | 15.1 | Comparative example |
| 42 | N | 100 | 0 | 7 | 8.2 | 1240 | 1446 | 8 | 10.2 | Comparative example |
| 43 | N | 100 | 0 | 1 | 4.3 | 1243 | 1466 | 8 | 130 | Comparative example |

TABLE 3-continued

| No. | Steel No. | Microstructure: Area fraction of martensite and bainite (%) | Microstructure: Area fraction of balance (%) | Microstructure: Number of inclusion clusters per mm$^2$ (clusters/mm$^2$) | Microstructure: Average prior-γ gain size (μm) | Mechanical properties: YP (MPa) | Mechanical properties: TS (MPa) | Mechanical properties: El (%) | Delayed fracture resistance: Delayed-fracture time (hr) | Remark |
|---|---|---|---|---|---|---|---|---|---|---|
| 44 | N | 100 | 0 | 1 | 4.1 | 1223 | 1540 | 7 | 115.0 | Comparative example |
| 45 | N | 100 | 0 | 1 | 21.1 | 1231 | 1420 | 8 | No fracture | Example |
| 46 | H | 100 | 0 | 2 | 12.3 | 1312 | 1554 | 7 | No fracture | Example |
| 47 | H | 100 | 0 | 3 | 20.5 | 1345 | 1442 | 8 | No fracture | Example |
| 48 | H | 100 | 0 | 3 | 4.4 | 1303 | 1583 | 7 | 89.1 | Comparative example |
| 49 | H | 90 | 10 | 3 | 9.8 | 1330 | 1492 | 8 | 95.0 | Comparative example |
| 50 | Q | 96 | 4 | 2 | 7.3 | 1600 | 1733 | 7 | 14.0 | Example |
| 51 | Q | 92 | 8 | 2 | 7.4 | 1586 | 1780 | 7 | 1.0 | Comparative example |
| 52 | V | 100 | 0 | 1 | 8.6 | 1791 | 2013 | 6 | 0.3 | Example |
| 53 | V | 100 | 0 | 2 | 10.7 | 7989 | 2021 | 6 | 0.3 | Example |
| 54 | V | 95 | 0 | 2 | 8.7 | 1814 | 1924 | 6 | 0.7 | Example |

The underlined items are outside the range specified in the disclosed embodiments.

The steels prepared with an appropriate composition, appropriate hot-rolling conditions, and appropriate annealing conditions (Nos. 1 to 24, 45 to 47, 50, and 52 to 54) had a TS of 1320 MPa or more and excellent delayed fracture resistance. That is, no crack was formed when TS<1560 MPa; the fracture time was $10^{(-0.008\times(TS-1760)+0.69)}$ or more when 1560 MPa≤TS≤1910 MPa; and the fracture time was 0.3 hr or more when 1910 MPa<TS.

In No. 25, where the C content was insufficient, the TS of the steel sheet was insufficient. In No. 26, where the C content was excessively high, the steel sheet had an excessively high strength and failed to have sufficiently high delayed fracture resistance.

In Nos. 27 to 34, where the steel composition was deviated from the range specified in the disclosed embodiments, the steel sheet had poor delayed fracture resistance due to, for example, large amounts of segregation and inclusions.

In Nos. 35, 37, and 40, where the Nb or Ti content was insufficient, the steel sheet had poor delayed fracture resistance. In Nos. 36, 38, and 39, where the Nb or Ti content was excessively high, a large amount of inclusion particles was formed and, consequently, the steel sheet had poor delayed fracture resistance.

In Nos. 41 and 42, where the slab-heating temperature or the holding time was insufficient, a large amount of inclusion particles was formed and, consequently, the steel sheet had poor delayed fracture resistance.

In No. 43, where the cold-rolling ratio was low, some of the austenite grains were coarsened during annealing and, consequently, the steel sheet failed to have a sufficiently high strength.

In Nos. 44 and 48, where the annealing temperature was low or the annealing time was insufficient, the size of prior-austenite grains fail to be increased to a sufficient degree and, consequently, the steel sheet had poor delayed fracture resistance.

In Nos. 49 and 51, where the cooling-start temperature was low or the cooling-stop temperature was high, microstructures other than martensite or bainite were formed in an excessive amount and, consequently, the steel sheet had poor delayed fracture resistance.

There was no clear relationship between the number density of the inclusion clusters and the improvement in delayed fracture resistance in the case where inclusion particles having a major axis of less than 0.3 μm were also included in particles constituting inclusion clusters; and in the case where inclusion particles such that the minimum distance between the inclusion particles was more than 10 μm were also included in particles constituting inclusion clusters.

Industrial Applicability

According to the disclosed embodiments, a high-strength steel sheet having excellent delayed fracture resistance at sheared end surfaces can be produced. The improvement in the properties of the steel sheet enables an ultrahigh-strength steel sheet to be used in applications where it has been difficult to use a high-strength steel having a TS of 1320 MPa or more because of delayed fracture that significantly occurs in such steel sheets and thereby contributes to an increase in the strengths of components and a reduction in the weights of components. Moreover, it becomes possible to use cold-press forming that includes shearing work for producing components that have been formed by hot pressing and laser machining. This may remarkably reduce the costs for production of such components.

The invention claimed is:

1. A steel sheet having a chemical composition comprising, by mass %:

C: 0.13% or more and 0.40% or less,
Si: 1.5% or less,
Mn: 1.7% or less,
P: 0.030% or less,
S: less than 0.0010%,
sol. Al: 0.20% or less,
N: 0.0055% or less,
O: 0.0025% or less,
Nb: 0.002% or more and 0.035% or less,
Ti: 0.002% or more and 0.040% or less, and
the balance being Fe and inevitable impurities, wherein the steel sheet has a microstructure including martensite and bainite, the total area fraction of the martensite and the bainite to the entirety of the microstructure being in a range of 95% or more and 100% or less, and the balance, if any, being at least one of ferrite and retained austenite, the microstructure including (i) prior-austenite grains having an average grain size of more than 5 μm , and (ii) inclusion clusters having a major axis of 20 to 80 μm, the content of the inclusion clusters in the microstructure being 5 clusters/mm2 or less, each of the inclusion clusters constituted by at least one inclusion particle, where:

in the case where each of the inclusion clusters is constituted by one inclusion particle, the inclusion particle has a major axis of 20 to 80 μm, and in the case where the inclusion clusters are constituted by two or more inclusion particles, the inclusion particles have a major axis of 0.3 μm or more, and the shortest distance between the inclusion particles is 10 μm or less, Formula (1) and Formula (2) are both satisfied:

$$[\%\ Ti]+[\%\ Nb]>0.007 \quad (1)$$

$$[\%\ Ti]\times[\%\ Nb]^2\leq 7.5\times10^{-6} \quad (2)$$

where [%Nb] and [%Ti] represent the contents (%) of Nb and Ti, respectively, and the steel sheet has a tensile strength of 1320 MPa or more.

2. The steel sheet according to claim 1, the chemical composition further comprising, by mass %, at least one group selected from Groups A-E:

Group A: B: 0.0002% or more and less than 0.0035%,

Group B: at least one element selected from the group consisting of Cu: 0.005% or more and 1% or less, and Ni: 0.01% or more and 1% or less, Group C: at least one element selected from the group consisting of:

Cr: 0.01% or more and 1.0% or less.

Mo: 0.01% or more and less than 0.3%,

V: 0.003% or more and 0.45% or less,

Zr: 0.005% or more and 0.2% or less, and

W: 0.005% or more and 0.2% or less,

Group D: at least one element selected from the group consisting of:

Ca: 0.0002% or more and 0.0030% or less,

Ce: 0.0002% or more and 0.0030% or less.

La: 0.0002% or more and 0.0030% or less, and

Mg: 0.0002% or more and 0.0030% or less, and

Group E: at least one element selected from the group consisting of Sb: 0.002% or more and 0.1% or less, and Sn: 0.002% or more and 0.1% or less.

3. The steel sheet according to claim 2, wherein the steel sheet has a coating layer disposed on a surface thereof.

4. The steel sheet according to claim 1, wherein the steel sheet has a coating layer disposed on a surface thereof.

5. A method for producing the steel sheet according to claim 1, the method comprising:

holding a steel slab having the chemical composition for 100 minutes or more with a slab-surface temperature of 1220° C. or more and subsequently hot-rolling the steel slab into a hot-rolled steel sheet;

cold-rolling the hot-rolled steel sheet into a cold-rolled steel sheet at a cold-rolling ratio of 40% or more; and performing continuous annealing of the cold-rolled steel sheet, the continuous annealing including treating the cold-rolled steel sheet for 240 seconds or more with an annealing temperature higher than 850° C., subsequently reducing the temperature from 680° C. or more to 260° C. or less at an average cooling rate of 70° C/s or more, then performing reheating as needed, and subsequently performing holding at a temperature in a range of 150° C. to 260° C. for in a range of 20 to 1500 seconds.

6. The method for producing a steel sheet according to claim 5, further comprising performing coating of the steel sheet subsequent to the continuous annealing.

7. A method for producing the steel sheet according to claim 2, the method comprising:

holding a steel slab having the chemical composition for 100 minutes or more with a slab-surface temperature of 1220° C. or more and subsequently hot-rolling the steel slab into a hot-rolled steel sheet;

cold-rolling the hot-rolled steel sheet into a cold-rolled steel sheet at a cold-rolling ratio of 40% or more; and performing continuous annealing of the cold-rolled steel sheet, the continuous annealing including treating the cold-rolled steel sheet for 240 seconds or more with an annealing temperature higher than 850° C., subsequently reducing the temperature from 680° C. or more to 260° C. or less at an average cooling rate of 70° C/s or more, then performing reheating as needed, and subsequently performing holding at a temperature in a range of 150° C. to 260° C. for in a range of 20 to 1500 seconds.

8. The method for producing a steel sheet according to claim 7, further comprising performing coating of the steel sheet subsequent to the continuous annealing.

* * * * *